United States Patent [19]

Tuchman

[11] Patent Number: 4,917,132

[45] Date of Patent: Apr. 17, 1990

[54] COMBINATION BRUSH AND MIRROR

[76] Inventor: Stephen Tuchman, 17 Allen Rd., Rockville Centre, N.Y. 11500

[21] Appl. No.: 158,887

[22] Filed: Feb. 22, 1988

[51] Int. Cl.[4] ..... A45D 42/00

[52] U.S. Cl. ..... 132/316; 206/581; 206/38; 206/235; 206/823

[58] Field of Search ..... 132/84 C, 83 E, 83 R, 132/79 A, 79 G, 80 A, 88.7, DIG. 3, 88.5, 103, 148, 291, 301, 304, 309, 311, 316, 320, 333; 206/581, 38, 235, 823; 15/106, 107

[56] References Cited

U.S. PATENT DOCUMENTS

| | | | |
|---|---|---|---|
| 573,240 | 12/1896 | Savage et al. | 132/80 A |
| 1,021,639 | 3/1912 | Smith | 132/84 C |
| 1,580,030 | 4/1926 | Friedman | 132/103 |
| 1,616,104 | 2/1927 | Bardera | 132/84 C |
| 1,847,496 | 4/1932 | Priest | 132/80 A |
| 2,466,783 | 4/1949 | Sarff | 132/83 R |
| 4,579,133 | 4/1986 | Seidler | 132/79 A |
| 4,726,387 | 2/1988 | Sarica | 132/79 A |

*Primary Examiner*—Robert Peshock
*Assistant Examiner*—Adriene J. Lepiane

[57] ABSTRACT

A convenience article of manufacture of a cosmetic brush and mirror characterized by a hollow elongated brush handle which serves as a storage compartment for the mirror having a correspondingly elongated size so that when withdrawn from the compartment it provides an effective visual guide for the use of the brush, and wherein the mirror and brush are frictionally interengaged to contribute to their use conjointly.

1 Claim, 1 Drawing Sheet

COMBINATION BRUSH AND MIRROR

The present invention relates generally to a cosmetic convenience article, and more particularly, to an article of manufacture which consists of two components, namely a brush component and a mirror component, wherein the mirror assists the user when applying facial cosmetics using the brush.

PRIOR ART

People who find it necessary to use facial make-up have come to prefer the cosmetic brush when compared to the old-fashioned powder puff. Manufacturers of cosmetics have recognized this and now supply a line of "pressed" products such as face powder, rouge or blush. It has been customary for the manufacturers to supply a small mirror within the case which houses the supply of pressed product. However, a constant annoyance with such an arrangement is the fogging of the mirror by the powdery product within the case. Mirrors on the outside of product cases as well as individual mirrors are also subject to clouding and smearing when transported within a cosmetic carrier usually used to contact a multitude of beauty aids and tools. This situation necessitates mirror cleaning as a prerequisite to cosmetic application.

The present invention provides for the ready accessibility of previous type mirrors but isolates the mirror itself from the usual adverse circumstances detracting from its use. More particularly, the cosmetic brush of the present invention is provided with a mirror which is stored in the sealed hollow of the brush handle and thus is always in a proper condition for use.

EXAMPLES OF THE PRIOR ART

In the known prior art, there are disclosures of hollow brush handles for storing sundry items, but usually not mirrors, and wherein the brushes are specifically toothbrushes.

More particularly, U.S. Pat. No. 1,021,639 issued on Mar. 26, 1912 to H.R. Smith discloses a toothbrush having a mirror 3 pivotally mounted, at 4, so as to be rotated from a storage position between bifurcated ends (not numbered) of the brush to a position extending therefrom, as shown in FIGS. 2 and 3.

U.S. Pat. No. 1,619,212 issued on Mar. 1, 1927, to S.A. Neederman discloses a mirror 3 mounted on the handle 2 of the toothbrush and alternately covered or exposed for use by a slidable cover 4.

Neither the Smith nor Neederman brush and mirror combination, or any other known similar arrangement, is satisfactory for applying facial powder or a similar cosmetic because of the inadequate size of the mirror or the inability with a simple construction to maintain the mirror in a proper condition for use. The description of the invention which follows, together with the accompanying drawings should not be construed as limiting the invention to the example shown and described, because those skilled in the art to which this invention appertains will be able to devise other forms thereof within the ambit of the appended claims.

Figure 5:
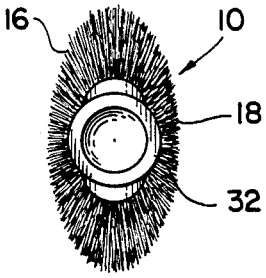
Figure 7:
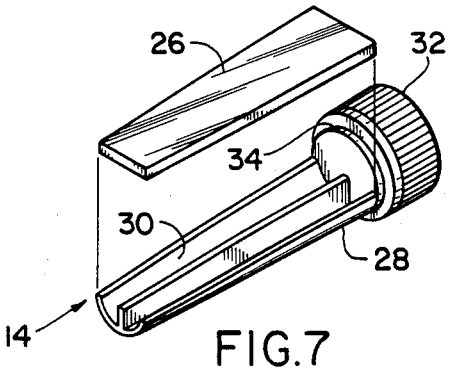
Figure 6:
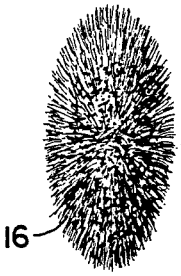

FIGS. 5 and 6 are end elevation views, FIG. 5 being the left end and FIG. 6 the right end; and FIG. 7 is a perspective view of the mirror component prior to its assembly. As already noted, the combination article of manufacture or device 10 hereof consists of two components, namely a brush component 12 and a mirror component 14, said components being shown as they would be typically used in FIG. 1.

Figure 3:
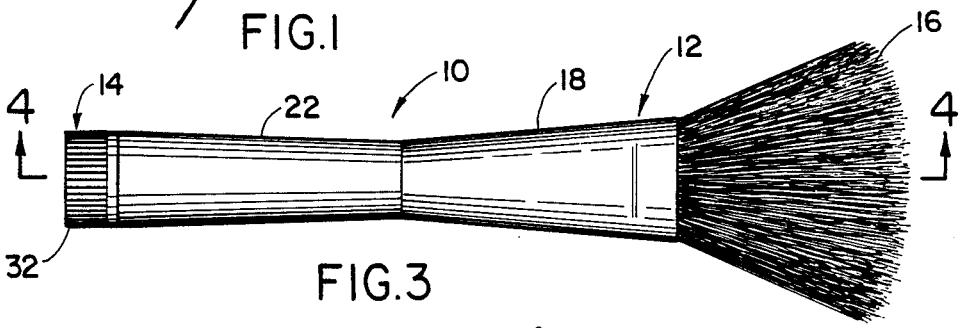
FIG. 3 is a plan view of the device in its assembled condition.
Figure 4:
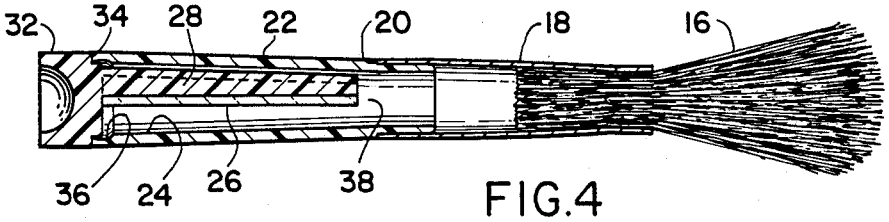
FIG. 4 is a view similar to FIG. 3, but taken in section along line 4—4 of FIG. 3, and illustrating internal structural features.

The details of construction of these components are perhaps best illustrated in FIGS. 3 and 4, to which reference should now be made. As shown therein, the brush component or assembly 12 will be understood to be made in a conventional fashion wherein either natural or synthetic hair provides the bristles 16 that are fastened by adhesive and crimping within a metal ferrule sleeve 18. Sleeve 18 is, in turn, press-fitted against a shoulder 20 in the tapered end of a cylindrical handle 22, which is hollow and thus provides a compartment 24 that is adapted to receive the mirror component or assembly 14 when the mirror is not in use, and is therefore in a stored condition.

Figure 1:
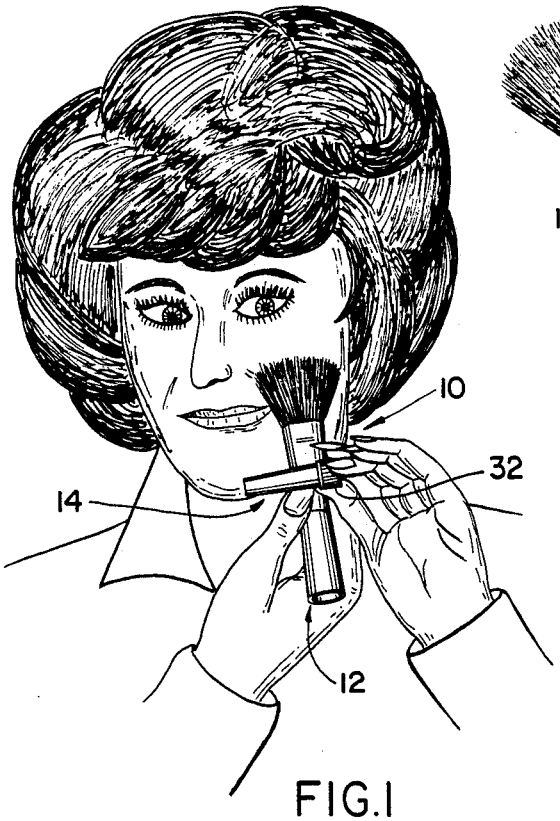
FIG. 1 is a front elevational view illustrating a typical use of the combination brush and mirror device or article of manufacture embodying the features of the present invention.
Figure 2:
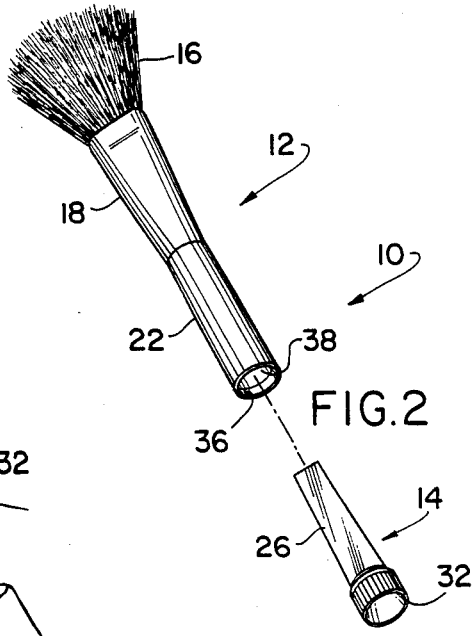
FIG. 2 is a perspective view of the device per se illustrating the mirror component thereof separated from the brush component.

Details of the mirror component 14 are most clearly illustrated in FIG. 7, to which reference should be made. This component consists of a mirror 26 and an appropriate support 28. More particularly, mirror 26 is of an elongated rectangular shape which is tapered slightly at the end which is projected within the brush storage compartment 24. Mirror 26 can be of the glass or plastic type shaped to fit on, and be cemented to, the portion of support 28 provided with an arm 30 having edges along which the mirror is adhesively attached to the arm 30. A lightly knurled, cylindrical end 32 is preferably provided on the end of the mirror support 28 and serves as a convenient finger grip, as illustrated in FIG. 1, when the mirror is being used to assist in the application of facial cosmetics using the brush component 12. As shown in FIG. 7, cylindrical end 32 is provided with a shoulder 34 which is sized to provide a snap fit and frictionally engage a hollowed-out seat 36 provided in the end opening 38 into the brush storage compartment 24.

Since the mirror 26 is only exposed during the application of cosmetics, it is very unlikely that its reflective surface will ever be in need of cleaning. Also, when not is use, the mirror 26 will be sealed within the forward end 38 of the storage compartment 24 and thus behind the seal established at the other end of the compartment, as at 36. On the other hand, when a vanity mirror or other reflector is available, it is obvious that the user can leave the mirror assembly 14 in place within handle 22 and still effectively use the brush in its FIG. 3 assembled condition.

In a preferred commercial embodiment, the overall length of the brush component is preferrably four inches, of which the sleeve 18 is approximately an inch and three-quarters, and the brush handle 22 is two and one-quarter inches. In these preferred conditions, therefore, the mirror 26 in its extending position from the cylindrical end 32 is approximately one and three-quarter inches, and it has been found in practice that a mirror of this size can be effectively used in conjunction with the brush 12 in the manner illustrated in FIG. 1.

While the particular article of manufacturer, consisting of a brush and mirror, herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A combination cosmetic brush and mirror article of manufacture comprising an elongated housing for said article having brush bristles extending from one end thereof and a hollow length portion at the opposite second end thereof serving as a handle for manipulating said brush bristles and bounding a cylindrically shaped storage compartment oriented longitudinally inwardly of said housing open at said second end, and a mirror with a cylindrical fingergrip constructed separate from said housing and removable therefrom selectively disposed in an internal storage position in said compartment so as to be frictionally engaged about the said fingergrip by an encircling housing wall bounding said storage compartment to contribute to subsequent convenient use conjointly of said brush and mirror upon withdrawal and separation of said mirror from said compartment, said mirror being comprised of said fingergrip and spaced wall means extending forwardly therefrom so as to be positioned in said longitudinally oriented compartment of said handle, and an image-reflecting mirrored surface disposed on said wall means in a lengthwise orientation in relation to said compartment being sized lengthwise to extend the entire length of said compartment whereby said image-reflecting mirrored surface is of a size to be effective in providing a reflected image of the user to serve as a visual guide for said manipulating of said brush bristles.

* * * * *